US010235979B1

(12) United States Patent
Sato

(10) Patent No.: US 10,235,979 B1
(45) Date of Patent: Mar. 19, 2019

(54) STAND AND HI-HAT STAND

(71) Applicant: HOSHINO GAKKI CO., LTD., Nagoya, Aichi (JP)

(72) Inventor: Naoki Sato, Nagoya (JP)

(73) Assignee: HOSHINO GAKKI CO., LTD., Nagoya (JP)

( * ) Notice: Subject to any disclaimer, the term of this patent is extended or adjusted under 35 U.S.C. 154(b) by 0 days.

(21) Appl. No.: 15/937,882

(22) Filed: Mar. 28, 2018

(30) Foreign Application Priority Data

Dec. 7, 2017 (JP) ..... 2017-235073

(51) Int. Cl.
*G10D 13/06* (2006.01)

(52) U.S. Cl.
CPC ..... *G10D 13/065* (2013.01)

(58) Field of Classification Search
CPC ..... G10D 13/065
USPC ..... 84/422.3
See application file for complete search history.

(56) References Cited

U.S. PATENT DOCUMENTS 3,405,587 A * 10/1968 Meazzi ..... G10D 13/026 84/421
5,072,910 A * 12/1991 May ..... F16M 11/28 248/170
5,251,528 A * 10/1993 Kurosaki ..... G10D 13/065 84/422.3
6,031,170 A * 2/2000 Hoshino ..... G10D 13/065 84/422.2
6,437,225 B1 * 8/2002 Shigenaga ..... G10D 13/065 84/422.1
6,491,266 B1 * 12/2002 Chen ..... F16M 11/16 248/163.1
7,484,558 B2 * 2/2009 Wood ..... E21B 15/006 166/75.14
7,588,228 B2 * 9/2009 May ..... G10D 13/026 248/165
7,703,725 B2 * 4/2010 May ..... G10D 13/026 248/163.1
7,802,764 B2 * 9/2010 Leinen ..... A61M 5/1415 248/129
8,967,585 B2 * 3/2015 Furuta ..... G10G 5/00 248/166
9,245,503 B2 * 1/2016 Allen ..... G10D 13/026
9,812,101 B1 * 11/2017 Miyajima ..... G10D 13/065
9,863,573 B2 * 1/2018 May ..... F16M 11/245
2003/0094089 A1 * 5/2003 Sato ..... G10D 13/065 84/422.3
2004/0051021 A1 * 3/2004 Micheel ..... G10D 13/026 248/346.01
2005/0109192 A1 * 5/2005 Miyajima ..... G10D 13/065 84/422.1
2005/0150357 A1 * 7/2005 Tanaka ..... G10D 13/065 84/422.3
2006/0086869 A1 * 4/2006 Hsieh ..... F16M 11/046 248/171

(Continued)

*Primary Examiner* — David S Warren
*Assistant Examiner* — Christina M Schreiber

(57) ABSTRACT

A hi-hat stand includes an upper pipe and a lower pipe. A leg unit includes leg plates, stays, a fixing collar, and a sliding collar. The leg plates and the stays are assembled with the lower pipe via the sliding collar and the fixing collar. On the outer circumferential surface of the lower pipe, a slide preventing surface is formed in a fixing position of the sliding collar. The slide preventing surface is formed by diamond knurling.

10 Claims, 8 Drawing Sheets

(56) References Cited

U.S. PATENT DOCUMENTS

| | | | | |
|---|---|---|---|---|
| 2006/0096444 | A1* | 5/2006 | Sato | F16M 11/10 84/422.3 |
| 2007/0012160 | A1* | 1/2007 | Sato | G10D 13/026 84/421 |
| 2008/0048074 | A1* | 2/2008 | May | F16M 11/34 248/176.1 |
| 2012/0210843 | A1* | 8/2012 | Sato | G10D 13/065 84/422.3 |
| 2013/0042745 | A1* | 2/2013 | Shimada | F16M 11/245 84/421 |
| 2014/0096664 | A1* | 4/2014 | Nakata | G10D 13/065 84/422.3 |

* cited by examiner

STAND AND HI-HAT STAND

CROSS-REFERENCE TO RELATED APPLICATIONS

This application is based upon and claims the benefit of priority from prior Japanese Patent Application No. 2017-235073, filed on Dec. 7, 2017, the entire contents of which are incorporated herein by reference.

BACKGROUND OF THE INVENTION

The present invention relates to a stand and a hi-hat stand including a leg unit configured to open and close.

A hi-hat stand (hereafter referred to as a "stand") 100 shown in FIG. 11, for example, includes an upper pipe 100*a* and a lower pipe 100*b*. The bottom cymbal of a hi-hat (not shown) is mounted on the upper pipe 100*a*. A leg unit configured to open and close is assembled with the lower pipe 100*b*. The stand 100 also includes a pedal plate 104 to be operated by the foot of a performer and a rod 105 inserted into the upper pipe 100*a*. The top cymbal of the hi-hat is mounted on the upper end of the rod 105. The lower end of the rod 105 is connected to the toe of the pedal plate 104 via a chain 106.

The leg unit includes three leg plates 101, three stays 102, a fixing collar 107, and a sliding collar 108. The fixing collar 107 is fixed in proximity to the lower end of the lower pipe 100*b*. The sliding collar 108 is mounted, at a position above the fixing collar 107, on the lower pipe 100*b*. The leg plates 101 are rotationally connected to the fixing collar 107. The stays 102 are rotationally connected to the middle portions of the respective leg plates 101 and to the sliding collar 108. The leg unit is configured to open and close in conjunction with the respective leg plates 101 and stays 102 by sliding the sliding collar 108 in the vertical direction.

When the sliding collar 108 slides up to the upper end of the lower pipe 100*b*, the stand 100 is in a position of retraction, in which the leg plates 101 and the stays 102 are closed. In contrast, when the sliding collar 108 slides up to the lower end of the lower pipe 100*b* and is stationary at that position after the sliding, the stand 100 is maintained in a position of use, in which the leg plates 101 and the stays 102 are open. The stand 100 is used when the tips of the leg plates 101 in an open state are located on the floor.

Further, the stand 100 is used while the pedal plate 104 is stationary at the lower end of the lower pipe 100*b* via a link mechanism 111. In this case, the link mechanism 111 positioned at the lower end of the lower pipe 100*b* is spaced from the floor. In this state, the performer plays the hi-hat by repeatedly moving the top cymbal vertically along with the rod 105 to bring the top cymbal into and out of contact with the bottom cymbal through a depressing operation of the pedal plate 104.

When the hi-hat is played, a load P from above caused by the vertical movement of the rod 105 and the top cymbal is repeatedly applied to the fixing collar 107 and the leg plates 101 via the upper pipe 100*a* and the lower pipe 100*b*. This load P is also repeatedly applied to the sliding collar 108 via the leg plates 101 and the stays 102. Accordingly, as the playing of the hi-hat continues, the lower pipe 100*b* gradually moves downward. When the load P is further applied, the link mechanism 111 may touch the floor, so that the tips of the leg plates 101 may be lifted from the floor. In such a case, because the tips of the leg plates 101 are spaced from the floor, the position of the stand 100 becomes unstable and the playing of the hi-hat may be hindered. In view of this, the stand 100 shown in FIG. 11 uses a movement preventing ring 110 to limit the downward movement of the lower pipe 100*b*. The movement preventing ring 110 is fixed to the outer circumferential surface of the lower pipe 100*b* at a position adjacent to the top surface of the sliding collar 108 by fastening a bolt 109.

Other than the above example, the stand disclosed in U.S. Pat. No. 9,245,503 includes a fixing collar having a vertically rotational bolt fixed on the lower end of a pipe. Further, a sliding collar has a bolt accommodating recess that accommodates the shaft of the bolt at a portion used to fix the fixing collar. According to the stand disclosed in this document, in order to assume the position of use, the sliding collar is caused to slide up to the lower end of the pipe, then the bolt of the fixing collar is rotated upward to fit into the bolt accommodating recess of the sliding collar, and the nut screwed onto the bolt is fastened. By fixing the sliding collar to the fixing collar so as to immobilize the sliding collar in the fixing position on the pipe in this manner, the downward movement of the pipe is limited.

However, in the case of the stand 100 shown in FIG. 11, the movement preventing ring 110 is necessary in addition to the parts constituting the leg unit. Accordingly, the number of the parts is increased, so that the costs of the parts and time necessary to assemble the parts may increase. Further, when the leg unit is opened or closed, it is necessary to fasten or loosen the bolt 109 in order to lock or unlock the movement preventing ring 110 in addition to the sliding of the sliding collar 108. In this manner, other than the opening or closing of the leg unit, it is necessary to slide the movement preventing ring 110. Thus, it takes time to set the stand 100. In the stand disclosed in U.S. Pat. No. 9,245,503, the operation to rotate the bolt of the fixing collar upward to fit into the bolt accommodating recess of the upper collar is annoying or troublesome for users. Further, since it is necessary to provide the fixing collar with a mechanism for rotating the bolt and provide the sliding collar with the bolt accommodating recess, the structures of the fixing collar and the sliding collar will be complicated.

SUMMARY OF THE INVENTION

It is an objective of the present invention to provide a stand and a hi-hat stand that improve the stability when in use without involving an additional part or an extra operation.

To achieve the foregoing objective, in accordance with one aspect of the present invention, a stand is provided. The stand includes a support having an axis; a plurality of leg plates and a plurality of stays, both of which are assembled with the support, wherein the leg plates and the stays are permitted to open and close relative to the axis of the support; and a sliding collar slidably mounted on an outer circumferential surface of the support, wherein the sliding collar is connected to the leg plates or the stays. The stand is configured to open and close the leg plates and the stays when the sliding collar slides in an axial direction of the support, and the stand is also configured to fix the sliding collar in a fixing position of the support, thereby maintaining a position of use in which the leg plates and the stays are open. The sliding collar has an inner circumferential surface to be brought into contact with the outer circumferential surface of the support. A slide preventing surface for increasing a frictional resistance between the sliding collar and the support is provided on at least either the outer circumferential surface of the support or the inner circumferential surface of the sliding collar.

To achieve the foregoing objective, in accordance with another aspect of the present invention, a hi-hat stand is provided. The hi-hat stand includes a support including a pipe on which a bottom cymbal is mounted, wherein the support has an axis; a rod inserted into the pipe, wherein the rod has an upper end on which a top cymbal is mounted; a pedal plate connected to a lower end of the rod via a connection member; a plurality of leg plates and a plurality of stays, both of which are assembled with the support, wherein the leg plates and the stays are permitted to open and close relative to the axis of the support; and a sliding collar slidably mounted on an outer circumferential surface of the support, wherein the sliding collar is connected to the leg plates or the stays. The hi-hat stand is configured to open and close the leg plates and the stays when the sliding collar slides in an axial direction of the support, and the hi-hat stand is also configured to fix the sliding collar in a fixing position of the support, thereby maintaining a position of use in which the leg plates and the stays are open. The sliding collar has an inner circumferential surface to be brought into contact with the outer circumferential surface of the support. A slide preventing surface for increasing a frictional resistance between the sliding collar and the support is provided on at least either the outer circumferential surface of the support or the inner circumferential surface of the sliding collar.

Other aspects and advantages of the embodiments will become apparent from the following description, taken in conjunction with the accompanying drawings, illustrating by way of example the principles of the invention.

BRIEF DESCRIPTION OF THE DRAWINGS

The embodiments, together with objects and advantages thereof, may best be understood by reference to the following description of the presently preferred embodiments together with the accompanying drawings in which.

DETAILED DESCRIPTION OF THE PREFERRED EMBODIMENTS

In the following, a hi-hat stand 10 according to one embodiment of the present invention is described with reference to FIGS. 1 to 5.

Figure 1:
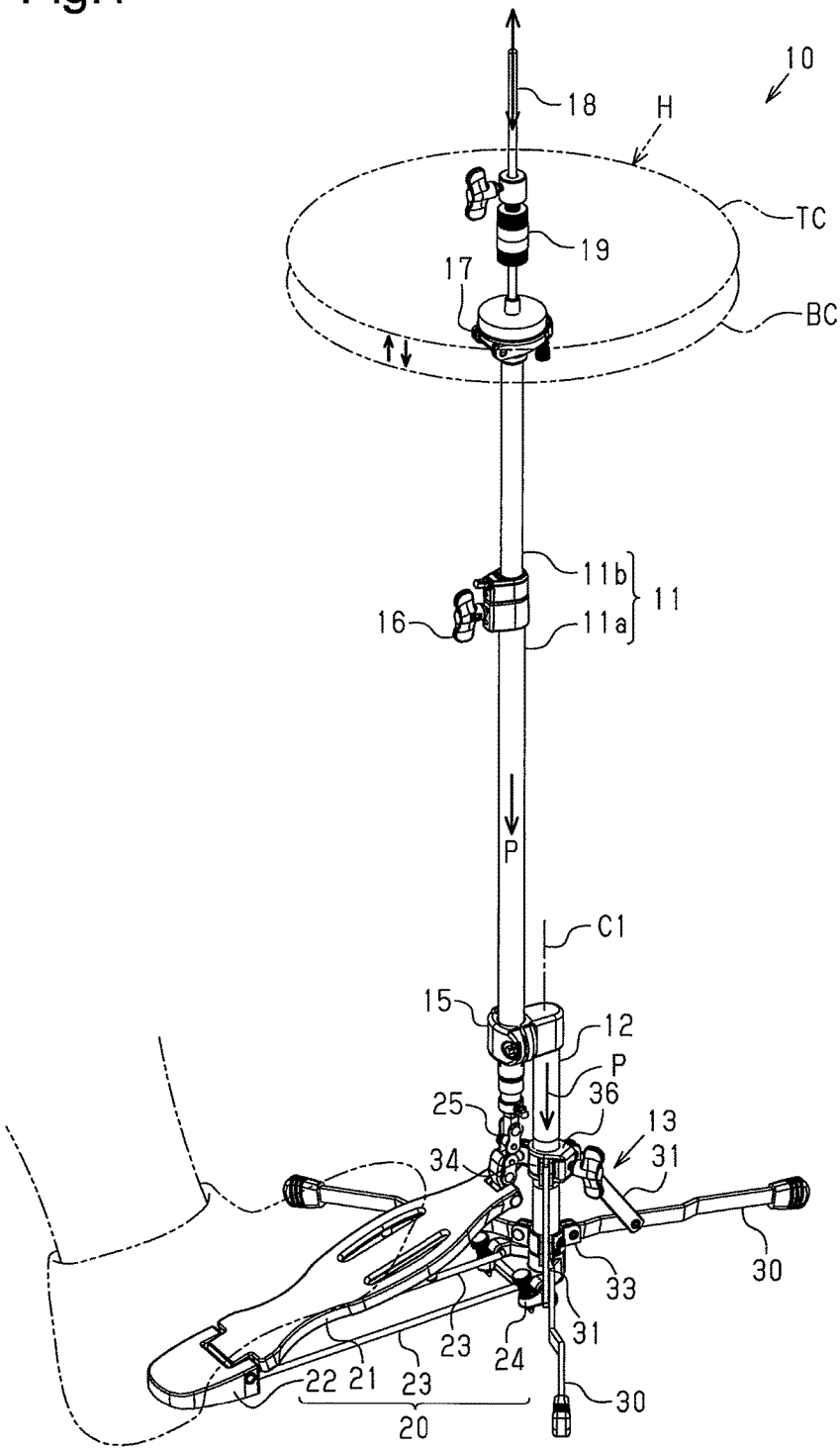
FIG. 1 is a perspective view of a general arrangement of a hi-hat stand according to one embodiment of the present invention.

As shown in FIG. 1, the hi-hat stand (hereafter referred to as a "stand") 10 includes an upper pipe 11 and a lower pipe 12 serving as a support. A bottom cymbal BC of a hi-hat H is mounted on the upper end of the upper pipe 11. A leg unit 13 configured to open and close relative to the axis C1 of the lower pipe 12 is assembled with the lower pipe 12. The upper pipe 11 and the lower pipe 12 are integrally located by a clamp 15 such that the axes of the upper pipe 11 and the lower pipe 12 are arranged in parallel.

The upper pipe 11 includes a first pipe 11*a* and a second pipe 11*b* slidably located within the first pipe 11*a*. The first pipe 11*a* is fixed to the upper end of the lower pipe 12 by the clamp 15. A first wing screw 16 to be operated for adjusting the height of the stand 10 is located at the upper end of the first pipe 11*a*. A hi-hat bottom 17 for supporting the bottom cymbal BC from underneath is fixed to the upper end of the second pipe 11*b*.

Further, the stand 10 includes a rod 18 inserted into the upper pipe 11 and a pedal assembly 20 connected to both the upper pipe 11 and the lower pipe 12. The rod 18 is movably inserted into the upper pipe 11 while the upper end of the rod 18 protrudes out of the upper end of the upper pipe 11. A hi-hat clutch 19 for mounting a top cymbal TC of the hi-hat H on the rod 18 is fixed on the upper end of the rod 18.

Figure 2:
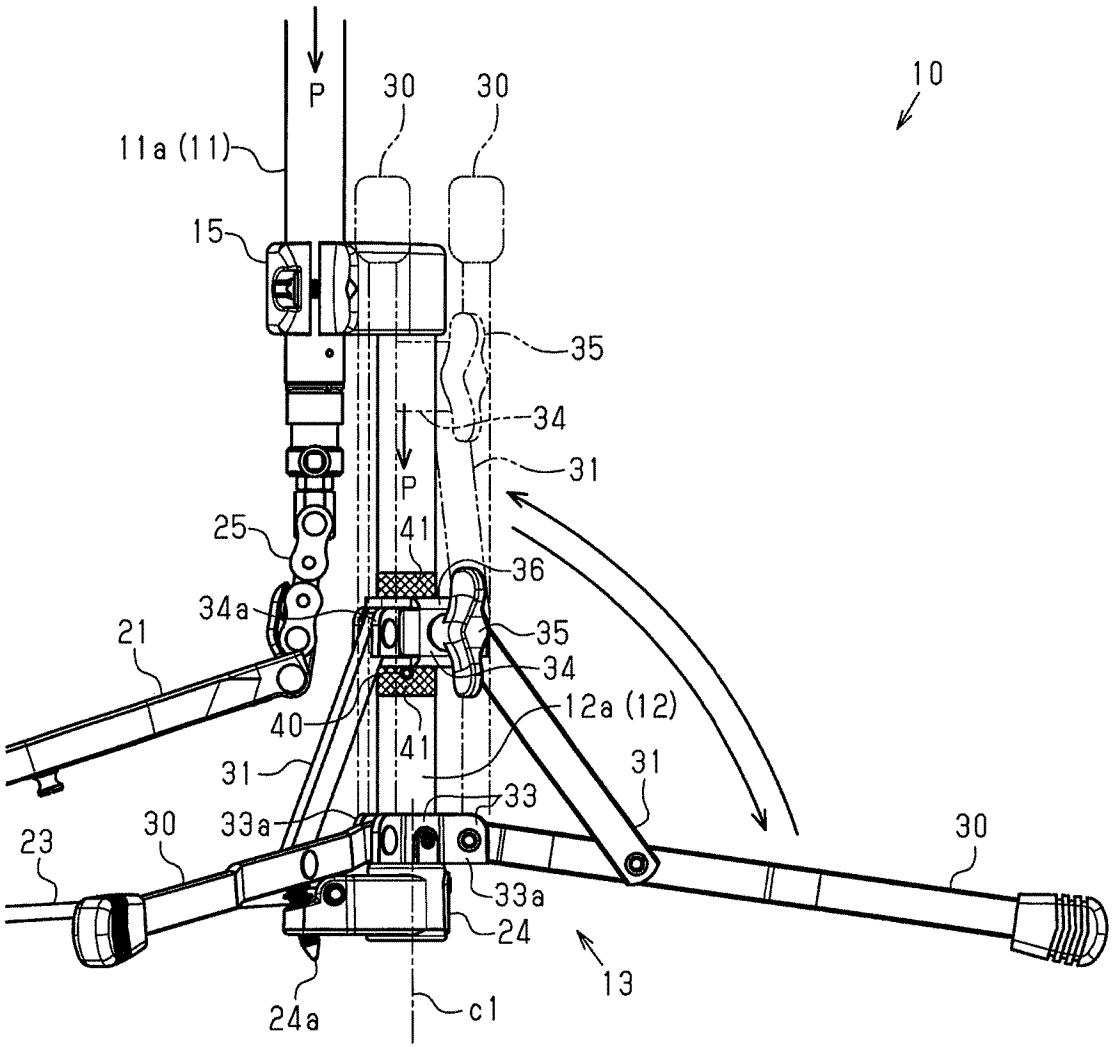
FIG. 2 is an enlarged partial side view of a vicinity of a leg unit of the hi-hat stand.

As shown in FIGS. 1 and 2, the pedal assembly 20 includes a pedal plate 21 to be operated by the foot of a performer, a heel unit 22, a pair of rods 23, and a link unit 24. The base end of the pedal plate 21 is rotationally connected to the heel unit 22. The lower end of the rod 18 is connected to the toe of the pedal plate 21 via a chain 25 serving as a connection member. The chain 25 supports the pedal plate 21 with the toe lifted.

The link unit 24 is fixed to the lower end of the lower pipe 12. The link unit 24 includes a pair of spikes 24*a* on the surface facing the floor. The rods 23 are connected to the heel unit 22 and the link unit 24, such that the pedal assembly 20 is connected to the lower end of the lower pipe 12. The pedal assembly 20 is connected to the lower end of the lower pipe 12, so that the pedal assembly 20 is arranged in a state where the heel unit 22 is placed on the floor and the tips of the pair of the spikes 24*a* abut on the floor.

Figure 3:
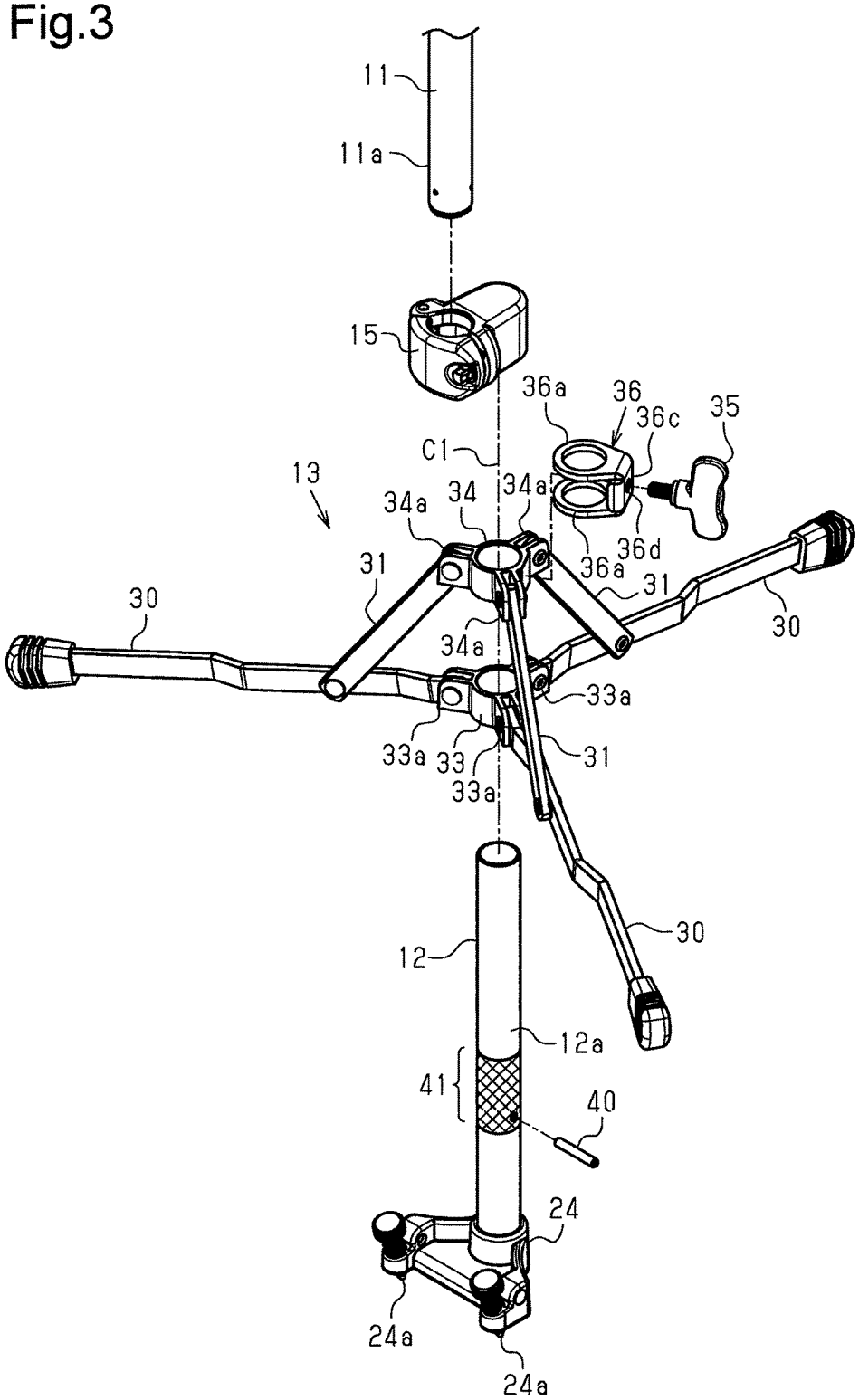
FIG. 3 is a partial exploded perspective view of the vicinity of the leg unit of the hi-hat stand.

As shown in FIGS. 2 and 3, the leg unit 13 includes three leg plates 30, three stays 31, a fixing collar 33, and a sliding collar 34. The fixing collar 33 is fixed, at a position adjacent to the top surface of the link unit 24, to an outer circumferential surface 12*a* of the lower pipe 12. The sliding collar 34 is mounted, at a position above the fixing collar 33, to the outer circumferential surface 12*a* of the lower pipe 12. The sliding collar 34 is configured to slide in the vertical direction along the axis C1 of the lower pipe 12. The leg plates 30 and the stays 31 are assembled with the lower pipe 12 via the sliding collar 34 and the fixing collar 33.

The fixing collar 33 has three leg unit connection tabs 33*a* extending outward in the radial direction from the outer circumferential surface of the fixing collar 33. The leg unit connection tabs 33*a* are provided on the outer circumferential surface of the fixing collar 33 at equal angular intervals. The sliding collar 34 has three stay connection tabs 34*a* extending outward in the radial direction from the outer circumferential surface of the sliding collar 34. The stay connection tabs 34*a* are provided on the outer circumferential surface of the sliding collar 34 at equal angular intervals.

Further, the leg unit 13 includes a second wing screw 35 serving as a fixing screw and a fastening ring 36 serving as a fastening member. The second wing screw 35 and the fastening ring 36 are parts for fixing the sliding collar 34 on the lower pipe 12. The second wing screw 35 is operated when the sliding collar 34 is to be fixed on the outer circumferential surface 12*a* of the lower pipe 12.

The fastening ring 36 includes a pair of upper and lower ring parts 36*a* and a fixing plate 36*c*. The lower pipe 12 is inserted through both ring parts 36*a* and is held by the ring parts 36*a*. A screw hole 36*d*, into which the second wing screw 35 is to be screwed, is provided at the center of the fixing plate 36*c*. The fastening ring 36 is mounted between two of the stay connection tabs 34*a* of the sliding collar 34. Further, the fastening ring 36 is mounted laterally on the sliding collar 34 such that the upper and lower ring parts 36*a* meet upper and lower opening ends of the sliding collar 34, respectively.

The leg plates 30 are rotationally connected to the respective leg unit connection tabs 33*a* of the fixing collar 33. The fixing collar 33 functions as a connector between the lower pipe 12 and the leg plates 30. The leg plates 30 open and close relative to the axis C1 of the lower pipe 12 by rotating on a position connected to the fixing collar 33. The stays 31 are rotationally connected to the respective stay connection tabs 34*a* of the sliding collar 34. The sliding collar 34 functions as a connector between the lower pipe 12 and the stays 31. The stays 31 open and close relative to the axis C1 of the lower pipe 12 by rotating on a position connected to the sliding collar 34.

The stays 31 are positioned above the respective leg plates 30. Further, the stays 31 are rotationally connected to the middle portions of the respective leg plates 30 as well as to the sliding collar 34. Accordingly, when the sliding collar 34 is caused to slide upward, the stays 31 rotate downward on the respective stay connection tabs 34*a*, and the leg plates 30 rotate upward on the respective leg unit connection tabs 33*a* while being pulled by the respective stays 31. Then, as shown by long dashed double-short dashed lines in FIG. 2, when the sliding collar 34 is cased to slide up to the upper end of the lower pipe 12, all the leg plates 30 and the stays 31 are completely closed, so that the stand 10 is in the position of retraction.

In contrast, when the sliding collar 34 is caused to slide downward, the stays 31 rotate upward on the respective stay connection tabs 34*a*, and the leg plates 30 rotate downward on the respective leg unit connection tabs 33*a* while being pushed by the respective stays 31. Then, when the sliding collar 34 is caused to slide up to a fixing position shown by solid lines in FIG. 2, all the leg plates 30 and the stays 31 are completely open, so that the stand 10 assumes the position of use. Further, by operating the second wing screw 35 to fix the sliding collar 34 in the fixing position on the lower pipe 12, the stand 10 is maintained in the position of use.

As described above, the leg unit 13 is configured to open and close in conjunction with the leg plates 30 and stays 31 by sliding the sliding collar 34 in the vertical direction. Further, the leg unit 13 is configured such that the leg plates 30 rotate more widely than the respective stays 31 by sliding the sliding collar 34 in the vertical direction. Specifically, in the leg unit 13, the leg plates 30 rotate between a closed position, where the leg plates 30 are arranged substantially in parallel with the axis C1 of the lower pipe 12, and an open position, where the leg plates 30 are arranged substantially orthogonal to the axis C1 of the lower pipe 12. By contrast, the stays 31 rotate between a closed position where the stays 31 are arranged substantially in parallel with the axis C1 of the lower pipe 12 and an open position where the stays 31 are arranged to cross the axis C1 of the lower pipe 12 at an angle of about 45 degrees. Accordingly, when the stand 10 is used, the leg plates 30 are open more widely than the respective stays 31.

A regulation pin 40 serving as a stopper is fixed to the outer circumferential surface 12*a* of the lower pipe 12. The regulation pin 40 is fixed in a direction orthogonal to the outer circumferential surface 12*a* of the lower pipe 12. Further, the position where the regulation pin 40 is fixed is adjacent to the lower opening end of the sliding collar 34 located in the fixing position on the lower pipe 12. The regulation pin 40 limits downward sliding of the sliding collar 34 over the fixing position on the lower pipe 12 by allowing the lower opening end of the sliding collar 34 to abut on an outer circumferential surface of the regulation pin 40.

The outer circumferential surface 12*a* of the lower pipe 12 has a slide preventing surface 41 on a portion that meets the sliding collar 34 and the fastening ring 36. The slide preventing surface 41 is provided so that the sliding collar 34 fixed on the lower pipe 12 does not slide due to a load P from above. The slide preventing surface 41 is formed on the outer circumferential surface 12*a* of the lower pipe 12 as a machined surface with known diamond knurling. The slide preventing surface 41 is provided for about twice the axial length of the sliding collar 34, so that upper end and lower end portions of the slide preventing surface 41 are exposed out of the fastening ring 36 mounted on the sliding collar 34 in a case where sliding of the sliding collar 34 is limited by the regulation pin 40.

Figure 4:
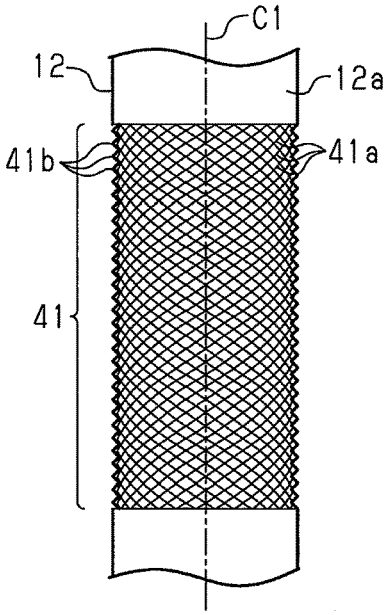
FIG. 4 is an enlarged partial plan view of a vicinity of a slide preventing surface of a lower pipe.
Figure 5:
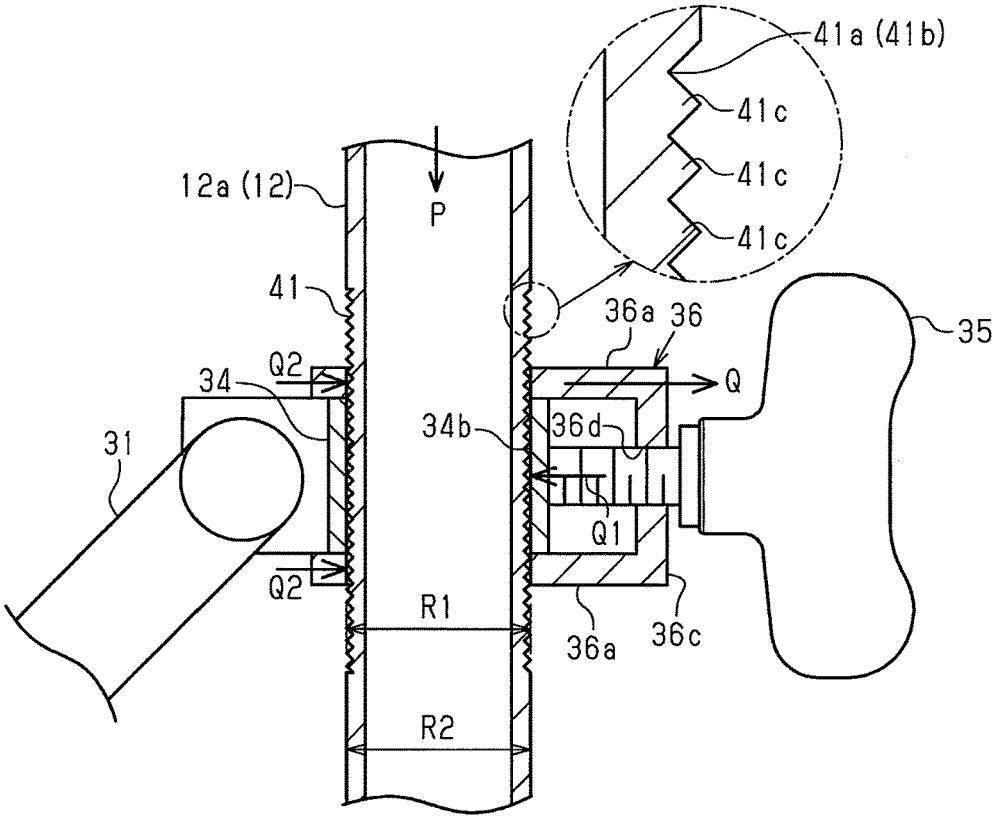
FIG. 5 is a partial cross-sectional view of the hi-hat stand when a sliding collar is fixed on the lower pipe.

As shown in FIGS. 4 and 5, the slide preventing surface 41 is formed around the entire outer circumferential surface 12*a* of the lower pipe 12. When the slide preventing surface 41 is in contact with an inner circumferential surface 34*b* of the sliding collar 34, the slide preventing surface 41 increases the frictional resistance between the sliding collar 34 and the lower pipe 12. Further, when the slide preventing surface 41 is in contact with inner circumferential surfaces of the ring parts 36*a* of the fastening ring 36, the slide preventing surface 41 increases the frictional resistance between the fastening ring 36 and the lower pipe 12. The slide preventing surface 41 has a plurality of fine recesses 41*a* and 41*b* provided by known diamond knurling.

The collection of the recesses 41*a* and 41*b* is a combination of first recesses 41*a* extending in a first direction of circumferential directions that cross the axis C1 of the lower pipe 12 and second recesses 41*b* extending in a second direction. The total number of the first recesses 41*a* is substantially the same as the total number of the second recesses 41*b*. The plurality of the first recesses 41*a* extend in the same direction from upper right to lower left in FIG. 4. The plurality of the second recesses 41*b* extend in the same direction from upper left to lower right in FIG. 4. Accordingly, the first recesses 41*a* and the second recesses 41*b* cross one another at the same angle.

As shown in FIG. 5, the cross-sectional shapes of the first recesses 41*a* and the second recesses 41*b* are triangular. Further, the cross-sectional shapes of a protrusion 41*c* formed between the adjacent first recesses 41*a* and a protrusion 41*c* formed between the adjacent second recesses 41*b* are also triangular. Further, the total numbers of the first recesses 41*a* and the second recesses 41*b* are substantially the same as the total number of the protrusions 41*c*. Accordingly, fine recesses and protrusions having the triangular cross-sectional shape are regularly arranged with a uniform density on the entire surface of the slide preventing surface 41.

The depth of the first recesses 41*a* is the same as the depth of the second recesses 41*b*. Accordingly, an opening edge of the first recesses 41*a* and an opening edge of the second recesses 41*b* are arranged on the same circumferential surface. Further, the opening edges of the first recesses 41*a* and the second recesses 41*b* are arranged on the same circumferential surface as the outer circumferential surface 12*a* of the lower pipe 12 on which no diamond knurling is provided. Accordingly, the diameter R1 of the slide preventing surface 41 of the lower pipe 12 is equal to the diameter R2 of the part of the lower pipe 12 where the slide preventing surface 41 of the lower pipe 12 is not formed.

In the following, an operation of the above stand 10 will be described with reference to FIGS. 1 to 5.

As shown by long dashed double-short dashed lines in FIG. 2, to put the stand 10 in the position of retraction, the sliding collar 34 is caused to slide upward, so that the leg plates 30 rotate upward while being pulled by the respective stays 31. In other words, the leg plates 30 rotate counterclockwise in FIG. 2 and assume a closed state relative to the axis C1 of the lower pipe 12.

In contrast, as shown by solid lines in FIG. 2, to put the stand 10 in the position of use, the sliding collar 34 is caused to slide downward, so that the leg plates 30 rotate downward while being pushed by the respective stays 31. In other words, the leg plates 30 rotate clockwise in FIG. 2 and assume an open state relative to the axis C1 of the lower pipe 12.

In the state shown by the solid lines in FIG. 2, the lower opening end of the sliding collar 34 abuts on the outer circumferential surface of the regulation pin 40. Accordingly, downward sliding of the sliding collar 34 over the fixing position on the lower pipe 12 is limited. In addition, the fixing position of the regulation pin 40 on the lower pipe 12 is set to be a position such that when the stand 10 is in the position of use, the link unit 24 is spaced from the floor and the tips of the spikes 24*a* abut on the floor. In other words, the regulation pin 40 is used for positioning the sliding collar 34 when the stand 10 is put in the position of use.

Further, in order to maintain the stand 10 in the position of use, as shown in FIG. 5, the second wing screw 35 screwed into the screw hole 36*d* of the fastening ring 36 is fastened, so that the sliding collar 34 is fixed in the fixing position on the lower pipe 12. In this case, the second wing screw 35 is fastened while its tip abuts on the outer circumferential surface of the sliding collar 34. Then, as shown by arrow Q in FIG. 5, the fastening ring 36 moves outward in the radial direction relative to the second wing screw 35 and the sliding collar 34. Accordingly, as shown by arrow Q2 in FIG. 5, inner circumferential surfaces of the ring parts 36*a* of the fastening ring 36, above and below the sliding collar 34, are pressed against the slide preventing surface 41 of the lower pipe 12. Further, as shown by arrow Q1 in FIG. 5, an inner circumferential surface 34*b* of the sliding collar 34 pushed by the tip of the second wing screw 35 is pressed against the slide preventing surface 41 of the lower pipe 12. In this manner, the sliding collar 34 together with the fastening ring 36 is fixed on the outer circumferential surface 12*a* of the lower pipe 12 due to the fastening force of the second wing screw 35.

As shown in FIG. 1, the performer puts the stand 10 in the position of use and plays the hi-hat H. In this case, the performer brings the top cymbal TC into and out of contact with the bottom cymbal BC while repeatedly moving the top cymbal TC vertically along with the rod 18 through a depressing operation of the pedal plate 21. Because of this, when the hi-hat H is played, a load P from above caused by the vertical movement of the rod 18 and the top cymbal TC is repeatedly applied to the sliding collar 34 via the leg plates 30 and the stays 31 as well as to the leg plates 30 and the stays 31 via the upper pipe upper pipe 11 and the lower pipe 12. Accordingly, as the playing of the hi-hat H continues, the lower pipe 12 gradually moves downward. When the load P is further applied, the link unit 24 fixed on the lower end of the lower pipe 12 may touch the floor, so that the tips of the leg plates 30 may be lifted from the floor. When the tips of the leg plates 30 are spaced from the floor, the position of the stand 10 becomes unstable and the playing of the hi-hat H may be affected.

Further, the stand 10 of this type has a structure in which the stays 31 are arranged above the respective leg plates 30. Accordingly, when the stand 10 is in the position of use, the leg plates 30 are open more widely than the stays 31, and the load P from above is likely to directly affect the leg plates 30 in terms of structure. Thus, compared with a stand 80 shown in FIG. 8 where stays 83 are arranged beneath respective leg plates 81, the leg plates 30 are prone to movement due to the load P from above and the position of the stand 10 is likely to become unstable.

In view of this, according to the present embodiment, as shown in FIGS. 3 and 4, on the outer circumferential surface 12*a* of the lower pipe 12, the slide preventing surface 41 is formed at the position on which the sliding collar 34 is to be fixed. The slide preventing surface 41 is formed by diamond knurling on the outer circumferential surface 12*a* of the lower pipe 12. In this case, the slide preventing surface 41 increases the frictional resistance between the sliding collar 34 and the lower pipe 12 while fixing the sliding collar 34 in the fixing position on the lower pipe 12. As a result, even if the load P from above affects the leg plates 30 or the sliding collar 34, the sliding collar 34 is less prone to movement from the fixing position on the lower pipe 12 and a downward movement of the lower pipe 12 is limited. Accordingly, the link unit 24 fixed on the lower end of the lower pipe 12 will not touch the floor, nor will the tips of the leg plates 30 be lifted from the floor. Since the tips of the leg plates 30 continue to be in touch without being spaced from the floor, the stability of the stand 10 when in use improves.

According to the present embodiment, the following advantages are provided.

(1) On the outer circumferential surface 12*a* of the lower pipe 12, the slide preventing surface 41 is formed at the position on which the sliding collar 34 is to be fixed. The slide preventing surface 41 increases the frictional resistance between the sliding collar 34 and the lower pipe 12 while fixing the sliding collar 34 in the fixing position on the lower pipe 12. As a result, even if the load P from above affects the leg plates 30 or the sliding collar 34, the sliding collar 34 is less prone to movement from the fixing position on the lower pipe 12, so that a downward movement of the lower pipe 12 is limited. Further, in this case, only the slide preventing surface 41 is provided on the outer circumferential surface 12*a* of the lower pipe 12. There is no need to add an additional part. Further, there is no need to have an extra operation other than an operation to maintain the stand 10 in the position of use. Accordingly, the stability of the stand 10 when in use improves without involving an additional part or an extra operation.

(2) On the slide preventing surface 41, a plurality of fine recesses 41*a* and 41*b* are provided. This structure allows the opening edges of the recesses 41*a* and 41*b* provided on the outer circumferential surface 12*a* of the lower pipe 12 to be brought into contact with the inner circumferential surface 34*b* of the sliding collar 34 to catch the inner circumferential surface 34*b*. This increases the frictional resistance between the sliding collar 34 and the lower pipe 12 while fixing the sliding collar 34 in the fixing position on the lower pipe 12.

(3) The opening edges of the recesses 41*a* and 41*b* are arranged on the same circumferential surface as the outer circumferential surface 12*a* of the lower pipe 12, on which no diamond knurling is provided. Accordingly, the diameter R1 of the slide preventing surface 41 of the lower pipe 12 is equal to the diameter R2 of the part of the lower pipe 12 where the slide preventing surface 41 is not formed. In this case, the frictional resistance between the sliding collar 34 and the lower pipe 12 is controlled to be low when the sliding collar 34 is not fixed in the fixing position on the lower pipe 12. This smoothly slides the sliding collar 34 and facilitates the operation to open or close the leg plates 30 and stays 31.

(4) The collection of the recesses 41*a* and 41*b* is a combination of the plurality of the first recesses 41*a* extending in the first direction of circumferential directions that cross the axis C1 of the lower pipe 12 and the plurality of the second recesses 41*b* extending in the second direction. This structure brings the sliding collar 34 and the lower pipe 12 into contact with each other in greater areas of the sliding collar 34 and the lower pipe 12 in the circumferential directions. This further increases the frictional resistance between the sliding collar 34 and the lower pipe 12 while the sliding collar 34 is fixed in the fixing position on the lower pipe 12.

(5) The cross-sectional shapes of the first recesses 41*a* and the second recesses 41*b* are triangular. Further, the cross-sectional shapes of the protrusion 41*c* formed between the adjacent first recesses 41*a* and the protrusion 41*c* formed between the adjacent second recesses 41*b* are also triangular. Further, fine recesses and protrusions having the triangular cross-sectional shape are regularly arranged with a uniform density on the entire surface of the slide preventing surface 41. This structure brings the sliding collar 34 and the lower pipe 12 into contact with each other using the protrusions 41*c* having the triangular cross-sectional shape. In this case, the tips of the protrusions having the triangular cross-sectional shape bite into the inner circumferential surface 34*b* of the sliding collar 34. In accordance with this, the frictional resistance between the sliding collar 34 and the lower pipe 12 is further increased while the sliding collar 34 is fixed in the fixing position on the lower pipe 12.

(6) The slide preventing surface 41 is formed on the outer circumferential surface 12*a* of the lower pipe 12 as a machined surface having known diamond knurling. Since the diamond knurling is a common metalworking process that is useful for anti-slip properties, the stability of the stand 10 when in use improves and the production costs of the stand 10 will be controlled to be low.

(7) The leg unit 13 includes the second wing screw 35 and the fastening ring 36. Further, when the second wing screw 35 is fastened, the fastening ring 36 moves outward in the radial direction relative to the second wing screw 35 and the sliding collar 34. This presses the inner circumferential surfaces of the ring parts 36*a* of the fastening ring 36 against the slide preventing surface 41 of the lower pipe 12. Further, the inner circumferential surface 34*b* of the sliding collar 34 pushed by the tip of the second wing screw 35 is pressed against the slide preventing surface 41 of the lower pipe 12. In this manner, the sliding collar 34 together with the fastening ring 36 is pressed against the outer circumferential surface 12*a* of the lower pipe 12 by strong force with the use of the fastening force of the second wing screw 35. Further, in this case, the operation to fasten the second wing screw 35 alone fixes the sliding collar 34 in the fixing position of the lower pipe 12 while increasing the frictional resistance caused by the contact between the inner circumferential surface 34*b* of the sliding collar 34 and the outer circumferential surface 12*a* of the lower pipe 12. Accordingly, handling is easier in comparison with a conventional stand including a mechanism to limit a downward movement of the lower pipe 12.

(8) The stand 10 is configured such that when it is in the position of use, the leg plates 30 open more widely than the stays 31 and the load P from above is likely to act on the leg plates 30 directly. In this respect, the present invention is configured such that the leg plates 30 are less prone to movement by limiting a downward movement of the lower pipe 12 caused by the load P from above. Accordingly, the present invention is especially useful for improving the stability of the stand 10 when in use, which has the above configuration.

(9) The regulation pin 40 is fixed on the outer circumferential surface 12*a* of the lower pipe 12. The regulation pin 40 is used for positioning the sliding collar 34 when the stand 10 is put in the position of use. Further, the outer circumferential surface 12*a* of the lower pipe 12 is provided with the slide preventing surface 41 only on a portion in proximity to the regulation pin 40. According to this configuration, a necessary area of the slide preventing surface 41 to be formed on the outer circumferential surface 12*a* of the lower pipe 12 can be controlled to be a minimum. Accordingly, the processing costs of the slide preventing surface 41 will be reduced, so that the production costs of the stand 10 will be controlled to be lower.

(10) The performer plays the hi-hat H by repeatedly moving the top cymbal TC vertically along with the rod 18 to bring the top cymbal TC into and out of contact with the bottom cymbal BC through a depressing operation of the pedal plate 21. In this respect, the present invention is configured such that the leg plates 30 are less prone to movement by limiting a downward movement of the lower pipe 12 caused by the load P from above. Accordingly, the present invention is especially useful for improving the stability of the hi-hat stand 10 when in use.

Modifications

The present examples and embodiments are to be considered as illustrative and not restrictive, and the invention is not to be limited to the details given herein, but may be modified within the scope and equivalence of the appended claims.

Figure 6:
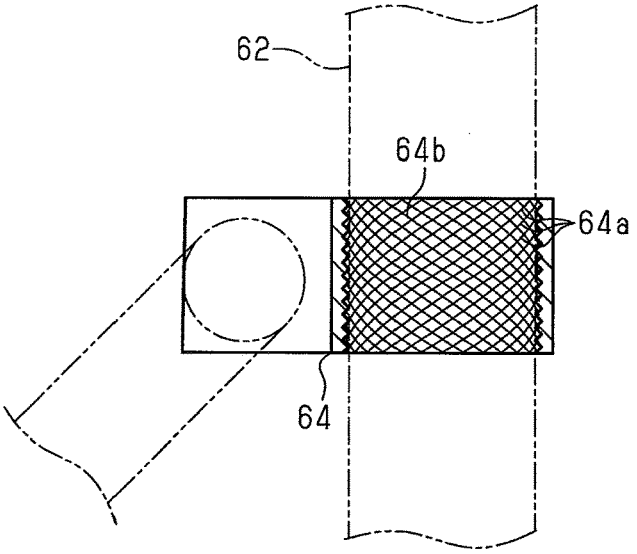
FIG. 6 is a vertical cross-sectional view of the inner arrangement of a sliding collar in another example.
Figure 7:
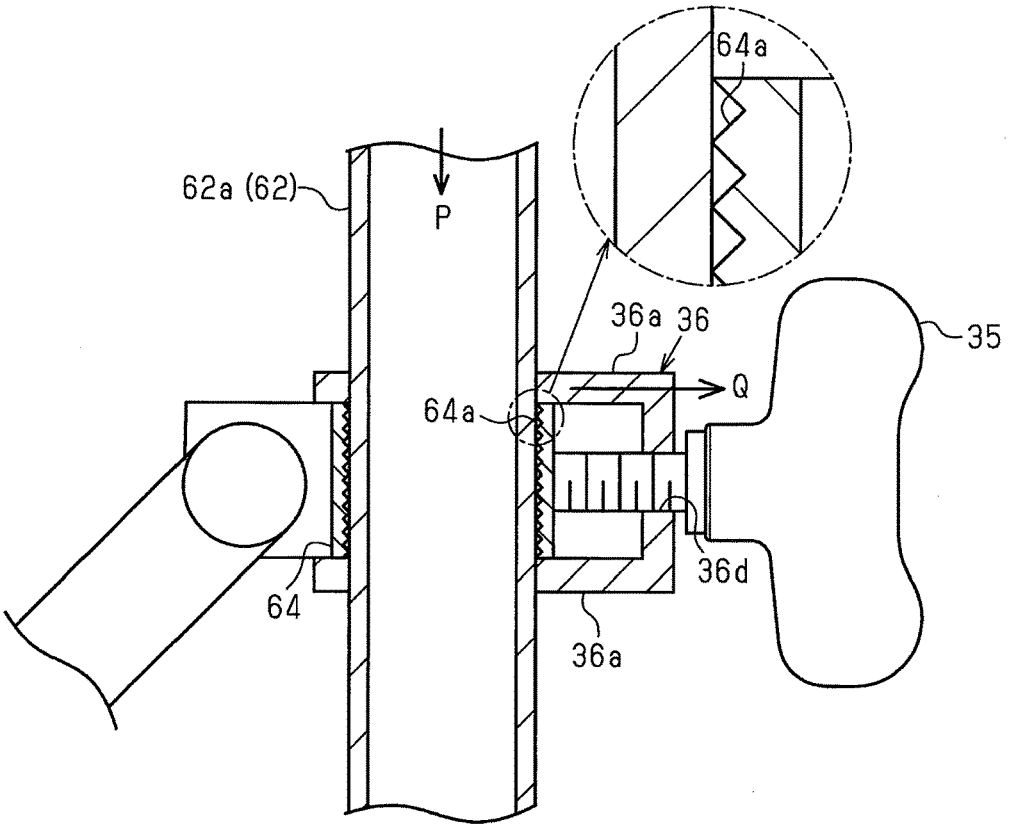
FIG. 7 is a partial cross-sectional view of a hi-hat stand when the sliding collar is fixed on a lower pipe.

As shown in FIGS. 6 and 7, recesses 64*a* may be formed on an inner circumferential surface 64*b* of a sliding collar 64 without forming recesses on an outer circumferential surface 62*a* of a lower pipe 62. In this case, a slide preventing surface is formed on the inner circumferential surface 64*b* of the sliding collar 64 rather than on the outer circumferential surface 62*a* of the lower pipe 62. As shown by arrow Q in FIG. 7, when the second wing screw 35 is fastened, the fastening ring 36 moves outward in the radial direction relative to the second wing screw 35 and the sliding collar 64. As a result, in the same manner as in the present embodiment, the inner circumferential surfaces of the ring parts 36*a* of the fastening ring 36 are pressed against the outer circumferential surface 62*a* of the lower pipe 62, and the inner circumferential surface 64*b* of the sliding collar 64 pushed by the tip of the second wing screw 35 is pressed against the outer circumferential surface 62*a* of the lower pipe 62. Accordingly, in this case, the operation to fasten the second wing screw 35 alone fixes the sliding collar 64 in a fixing position of the lower pipe 62 while increasing a frictional resistance caused by the contact between the inner circumferential surface 64*b* of the sliding collar 64 and the outer circumferential surface 62*a* of the lower pipe 62.

Figure 8:
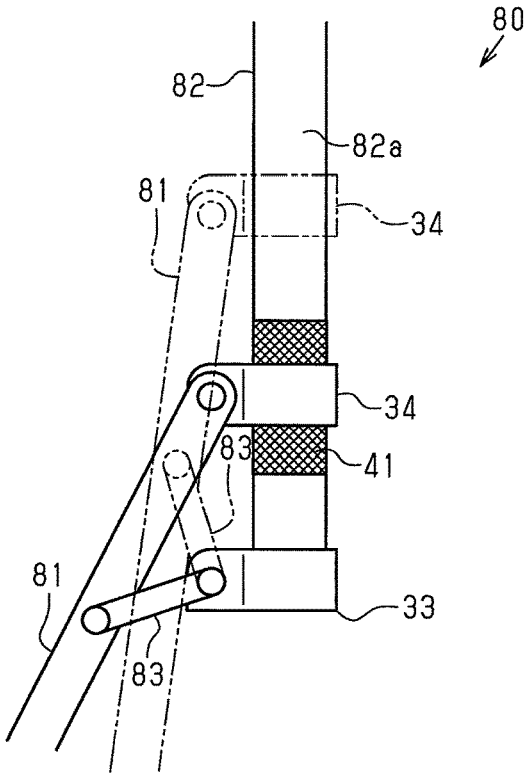
FIG. 8 is an enlarged partial side view of a vicinity of a leg unit of a hi-hat stand in another example.

As shown in FIG. 8, the present invention may be applied to the stand 80 where the stays 83 are arranged beneath the respective plates 81. In this case, the plates 81 are rotationally connected to the sliding collar 34. Further, the stays 83 are rotationally connected to the middle portions of the respective plates 81 and to the fixing collar 33. Also in this case, on an outer circumferential surface 82*a* of a pipe 82 serving as a support, the slide preventing surface 41 may be formed at a position on which the sliding collar 34 is to be fixed.

Figure 9A:
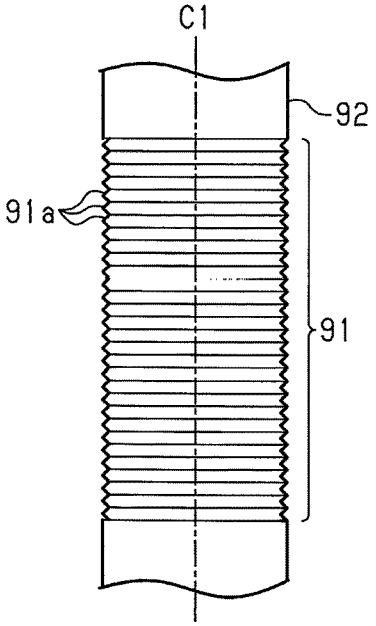
FIGS. 9A and 9B are partial plan views of lower pipes having slide preventing surfaces in other examples.
Figure 9B:
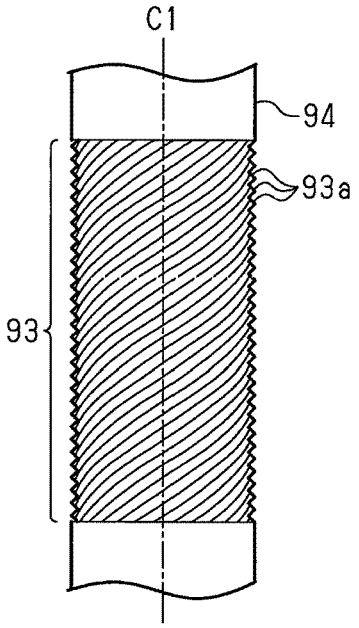

As shown in FIG. 9A, only recesses 91*a* extending in the circumferential directions orthogonal to the axis C1 of the lower pipe 92 may be formed on a slide preventing surface 91. Further, as shown in FIG. 9B, only recesses 93*a* extending in a first direction of the circumferential directions that cross the axis C1 of a lower pipe 94 may be formed on a slide preventing surface 93. In other words, on the slide preventing surface 41 shown in FIG. 4, the plurality of the second recesses 41*b* extending in the second direction may be removed.

Figure 10A:
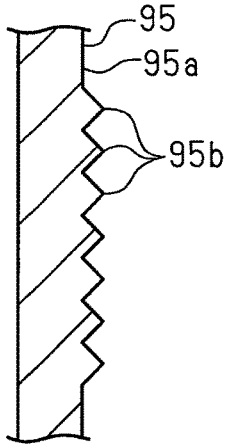
FIGS. 10A to 10C are partial longitudinal cross-sectional views of lower pipes having slide preventing surfaces in other examples.

As shown in FIG. 10A, protrusions 95*b* instead of recesses may be formed on an outer circumferential surface 95*a* of a lower pipe 95. In this case, the cross-sectional shape of the protrusions 95*b* may be any polygonal shape in addition to a triangle.

Figure 10B:
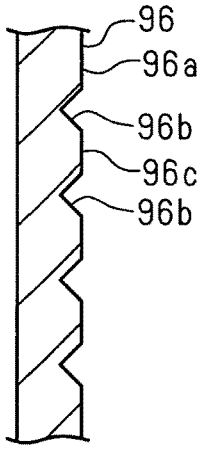
Figure 10C:
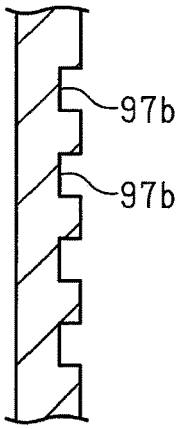
Figure 11:
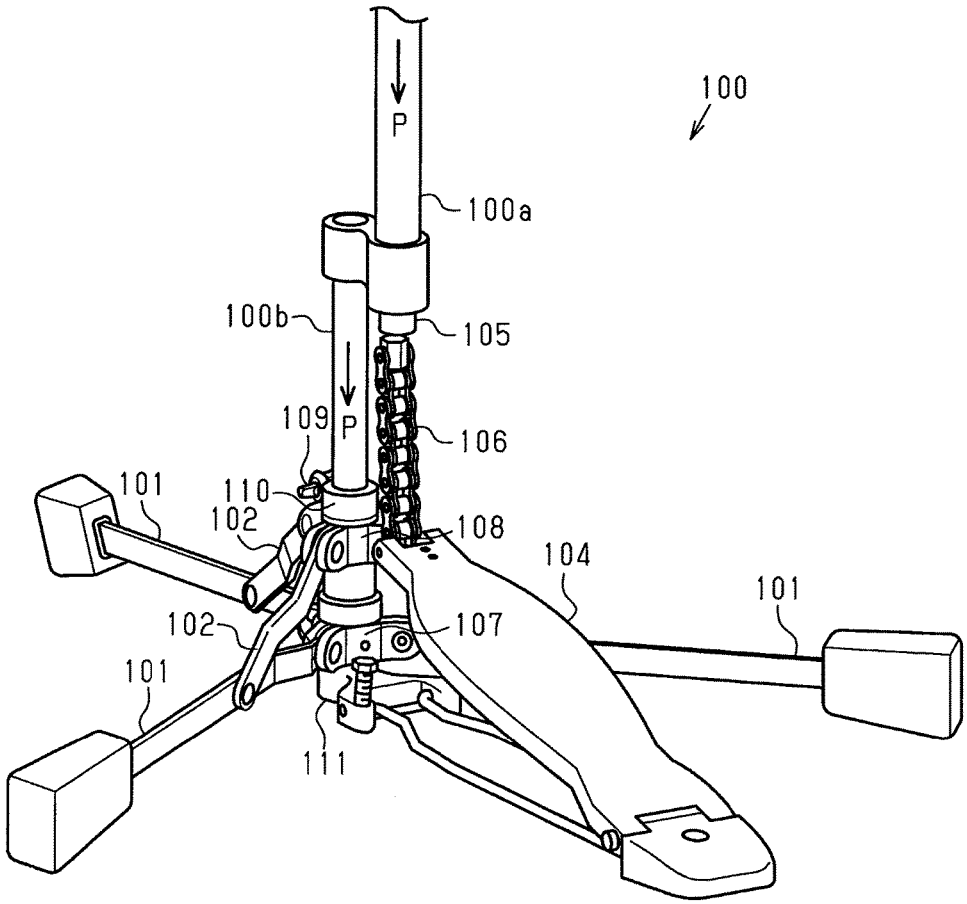
Fig.11 (Related Art)
FIG. 11 is a partial exploded perspective view of the vicinity of a leg unit of a conventional hi-hat stand.

As shown in FIG. 10B, recesses 96*b* having a triangular cross-sectional shape may be formed on an outer circumferential surface 96*a* of a lower pipe 96 and flats 96*c* may be formed between the adjacent recesses 96*b*. Further, as shown in FIG. 10C, the cross-sectional shape of recesses 97*b* may be modified to be a rectangle or any polygonal shape.

In the present embodiment, the recesses 41*a* and 41*b* may be formed on both the outer circumferential surface 12*a* of the lower pipe 12 and the inner circumferential surface 34*b* of the sliding collar 34. Further, instead of the recesses 41*a* and 41*b*, the protrusions 95*b* shown in FIG. 10A may be formed on both the outer circumferential surface 12*a* of the lower pipe 12 and the inner circumferential surface 34*b* of the sliding collar 34. Further, the recesses 41*a* and 41*b* may be formed on one of the outer circumferential surface 12*a* of the lower pipe 12 and the inner circumferential surface 34*b* of the sliding collar 34 while the protrusions 95*b* are formed on the other surface.

In the present embodiment, the slide preventing surface 41 may be formed through any processing method such as blast processing or satin finishing other than diamond knurling, by which recesses and protrusions are formed.

In the present embodiment, the regulation pin 40 may be removed.

The present invention may be applied to stand-type chairs, tables, and the like having a leg unit configured to open and close.

The present examples and embodiments are to be considered as illustrative and not restrictive, and the invention is not to be limited to the details given herein, but may be modified within the scope and equivalence of the appended claims.

The invention claimed is:

1. A stand, comprising:

a support having an axis;

a plurality of leg plates and a plurality of stays, both of which are assembled with the support, wherein the leg plates and the stays are permitted to open and close relative to the axis of the support; and a sliding collar slidably mounted on an outer circumferential surface of the support, wherein the sliding collar is connected to the leg plates or the stays, wherein the stand is configured to open and close the leg plates and the stays when the sliding collar slides in an axial direction of the support, and the stand is also configured to fix the sliding collar in a fixing position of the support, thereby maintaining a position of use in which the leg plates and the stays are open, the sliding collar has an inner circumferential surface to be brought into contact with the outer circumferential surface of the support, a slide preventing surface for increasing a frictional resistance between the sliding collar and the support is provided on the outer circumferential surface of the support, at least either recesses or protrusions are provided on the slide preventing surface, and at least either the recesses or the protrusions extend in a circumferential direction that crosses the axis of the support in a side view.

2. The stand according to claim 1, wherein the slide preventing surface is a machined surface that is formed by providing diamond knurling on the outer circumferential surface of the support.

3. The stand according to claim 1, further comprising:

a fastening member mounted on the sliding collar, wherein the fastening member holds the support and has a screw hole; and a fixing screw screwed into the screw hole of the fastening member, wherein the fixing screw fixes the sliding collar to the support, wherein the fastening member is configured to move outward in a radial direction when the fixing screw is fastened with a tip of the fixing screw abutting on the sliding collar.

4. The stand according to claim 1, wherein the leg plates are each rotationally connected to the support, the sliding collar is arranged above a connector between the support and the leg plates, the stays are each rotationally connected to corresponding ones of the leg plates and to the sliding collar, and the leg plates are configured to rotate downward to open when the sliding collar slides towards the connector, and the leg plates are also configured to rotate upward to close when the sliding collar slides away from the connector.

5. The stand according to claim 1, further comprising a stopper arranged on the outer circumferential surface of the support, wherein the stopper limits sliding of the sliding collar over a fixing position of the support, wherein the outer circumferential surface of the support is provided with the slide preventing surface only on a portion in proximity to the stopper.

6. A stand, comprising:

a support having an axis;

a plurality of leg plates and a plurality of stays, both of which are assembled with the support, wherein the leg plates and the stays are permitted to open and close relative to the axis of the support; and a sliding collar slidably mounted on an outer circumferential surface of the support, wherein the sliding collar is connected to the leg plates or the stays, wherein the stand is configured to open and close the leg plates and the stays when the sliding collar slides in an axial direction of the support, and the stand is also configured to fix the sliding collar in a fixing position of the support, thereby maintaining a position of use in which the leg plates and the stays are open, the sliding collar has an inner circumferential surface to be brought into contact with the outer circumferential surface of the support, a slide preventing surface for increasing a frictional resistance between the sliding collar and the support is provided on the inner circumferential surface of the sliding collar, at least either recesses or protrusions are provided on the slide preventing surface, and at least either recesses or protrusions extend in a circumferential direction that crosses an axis of the sliding collar in a side view.

7. The stand according to claim 6, wherein the slide preventing surface is a machined surface that is formed by providing diamond knurling on the inner circumferential surface of the sliding collar.

8. The stand according to claim 6, further comprising:

a fastening member mounted on the sliding collar, wherein the fastening member holds the support and has a screw hole; and a fixing screw screwed into the screw hole of the fastening member, wherein the fixing screw fixes the sliding collar to the support, wherein the fastening member is configured to move outward in a radial direction when the fixing screw is fastened with a tip of the fixing screw abutting on the sliding collar.

9. The stand according to claim 6, wherein the leg plates are each rotationally connected to the support, the sliding collar is arranged above a connector between the support and the leg plates, the stays are each rotationally connected to corresponding ones of the leg plates and to the sliding collar, and the leg plates are configured to rotate downward to open when the sliding collar slides towards the connector, and the leg plates are also configured to rotate upward to close when the sliding collar slides away from the connector.

10. A hi-hat stand, comprising:

a support including a pipe on which a bottom cymbal is mounted, wherein the support has an axis;

a rod inserted into the pipe, wherein the rod has an upper end on which a top cymbal is mounted;

a pedal plate connected to a lower end of the rod via a connection member;

a plurality of leg plates and a plurality of stays, both of which are assembled with the support, wherein the leg plates and the stays are permitted to open and close relative to the axis of the support; and a sliding collar slidably mounted on an outer circumferential surface of the support, wherein the sliding collar is connected to the leg plates or the stays, wherein the hi-hat stand is configured to open and close the leg plates and the stays when the sliding collar slides in an axial direction of the support, and the hi-hat stand is also configured to fix the sliding collar in a fixing position of the support, thereby maintaining a position of use in which the leg plates and the stays are open, the sliding collar has an inner circumferential surface to be brought into contact with the outer circumferential surface of the support, and a slide preventing surface for increasing a frictional resistance between the sliding collar and the support is provided on the outer circumferential surface of the support, at least either recesses or protrusions are provided on the slide preventing surface, and at least either the recesses or the protrusions provided on the outer circumferential surface of the support extend in a circumferential direction that crosses the axis of the support in a side view.

* * * * *